United States Patent [19]

Kordecki

[11] Patent Number: 4,758,152

[45] Date of Patent: Jul. 19, 1988

[54] SAFETY MECHANISM FOR A CIGAR LIGHTER

[75] Inventor: Jo Kordecki, Mesa, Ariz.

[73] Assignee: Gary Michael Price, Scottsdale, Ariz. ; a part interest

[21] Appl. No.: 56,222

[22] Filed: Jun. 1, 1987

[51] Int. Cl.[4] ..... F23D 11/36

[52] U.S. Cl. ..... 431/153; 431/277

[58] Field of Search ..... 431/276, 277, 254, 153, 431/144

[56] References Cited

U.S. PATENT DOCUMENTS

| | | | |
|---|---|---|---|
| 3,938,943 | 2/1976 | Malamoud | 431/144 |
| 4,028,043 | 6/1977 | Neyret | 431/144 |
| 4,049,370 | 9/1977 | Meyret | 431/144 |
| 4,181,490 | 1/1980 | Nitta | 431/277 |

*Primary Examiner*—Carroll B. Dority, Jr.

*Attorney, Agent, or Firm*—Harry M. Weiss & Associates

[57] ABSTRACT

A nylon bar is pivotably connected to a sleeve about a top portion of a cigar lighter of a type that has a lever that is depressed to cause fumes to pass from a fuel tank of the lighter. The bar may be locked in a position that prevents depression of the lever.

6 Claims, 1 Drawing Sheet

SAFETY MECHANISM FOR A CIGAR LIGHTER

BACKGROUND OF THE INVENTION

1. Field of the Invention

This invention is in the field of fire prevention and, more particularly, relates to a safety mechanism for a cigar lighter.

2. Description of the Prior Art

Approximately forty percent of all hostile fires in the United States are caused by inadvertent misuse of a cigar lighter. One type of a cigar lighter is comprised of a hand-held fuel tank that contains a lighter fluid, such as butane.

The tank has an orifice at one end that is opened in response to pressure being applied to a spring loaded lever. When the pressure is removed, the spring maintains the lever in a position that seals the orifice, thereby preventing flammable fumes of butane from leaving the tank.

Typically, the lighter includes a knurled thumbwheel that is operable to rotate and abraid a flintstone fixedly mounted on the tank. The thumbwheel is adjacent to the lever. When user's thumb rotates the thumbwheel, the abrasion of the flintstone causes a spark. Because the thumbwheel is adjacent to the lever, the thumb slips from the thumbwheel to the lever, thereby applying pressure to the lever as the spark is formed. The pressure causes a depression of the lever, thereby removing the seal of the orifice and causing the butane fumes to be ignited by the spark. The butane fumes burn until pressure is removed from the lever to cause the lever to return to the position that seals the orifice.

Heretofore, there has been no mechanism available to inhibit the inadvertent misuse of the lighter by a child, for example. There is no need for a mechanism that prevents fires caused by the inadvertent misuse.

SUMMARY OF THE INVENTION

An object of the present invention is to prevent inadvertent misuse of a cigar lighter.

According to the present invention, a cigar lighter includes a pivotably mounted bar that is operable to lock in a position that maintains a lever of the lighter in a position that seals an orifice in the fuel tank of the lighter.

The present invention prevents inadvertent misuse of a cigar lighter.

DESCRIPTION OF THE PREFERRED EMBODIMENT

Figure 1:
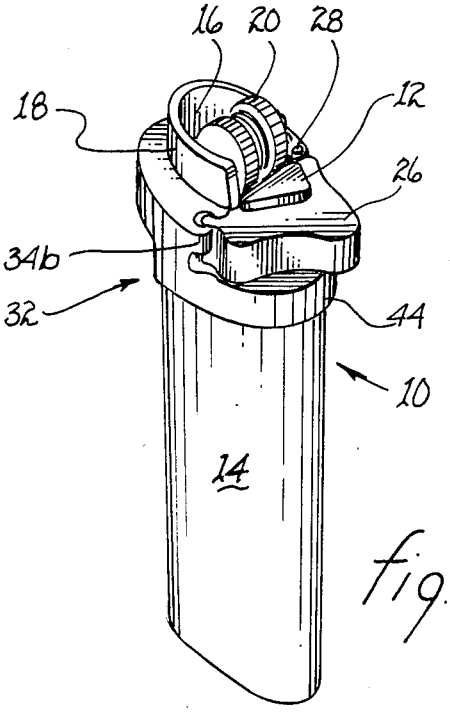
FIG. 1 is a perspective view of the preferred embodiment of the present invention.
Figure 2:
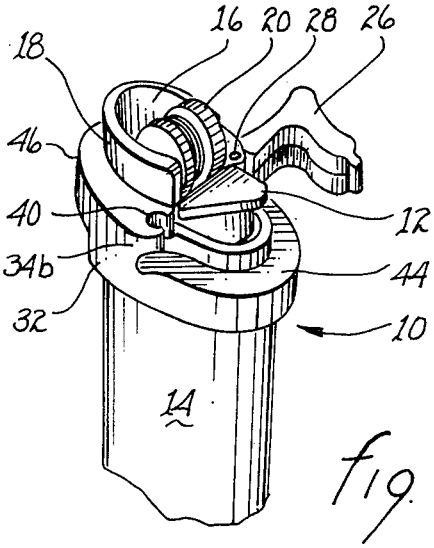
FIG. 2 is a perspective view of the embodiment of FIG. 1 with a safety mechanism in an open position.
Figure 3:
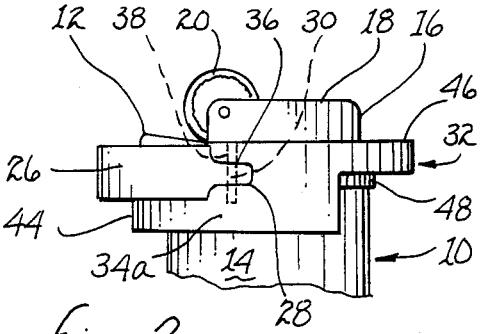
FIG. 3 is a side elevation of the embodiment of FIG. 1.
Figure 5:
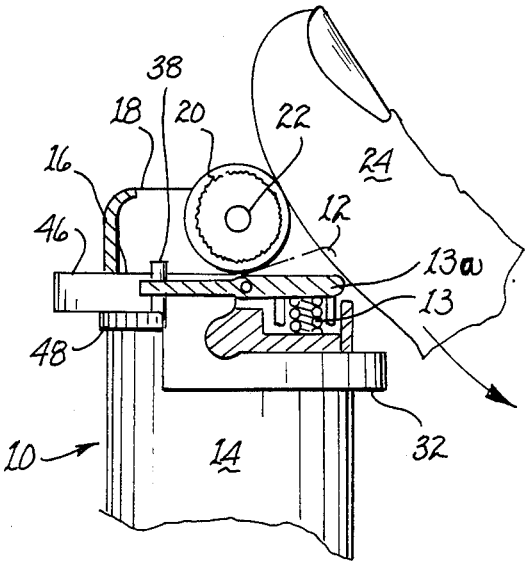
FIG. 5 is a side elevation, with parts broken away, of the embodiment of FIG. 1 with a safety mechanism in a lock position.
Figure 4:
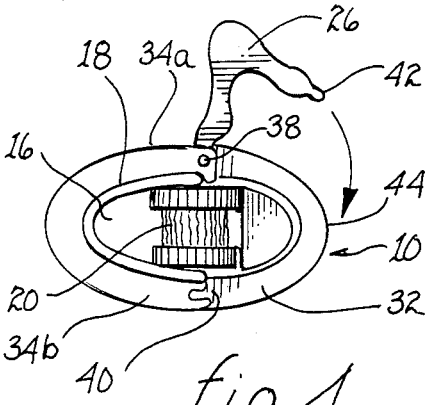
FIG. 4 is a plan view of the embodiment of FIG. 1.

As shown in FIGS. 1–5, a cigar lighter includes a lever 12 connected to a spring 13 that is within housing 13*a*. Hence, lever 12 is spring loaded.

When lever 12 is depressed, it opens an orifice (not shown) in a fuel tank 14 near the closed end 16 of an arcuate fire wall 18. Lighter 10 further includes a knurled thumbwheel 20 that is rotatable about an axially supporting member 22 (FIG. 5) connected to fire wall 18. Thumbwheel 20 is operable for rotation by a persons thumb 24. When thumbwheel 20 is rotated, it abraids a flint (not shown) that causes a spark. Additionally, almost concurrently with the rotation, thumb 24 applies pressure to lever 12.

In the present invention, a bar 26, in the general shape of a bellcrank, is operable to lock in a position to maintain lever 12 against depression, thereby keeping the orifice sealed and preventing the spark from igniting fumes of the fuel. Bar 26 has a proximal end 28 (FIG. 3) made of metal. End 28 has a through hole 30 which retains a pin as explained hereinafter. The remainder of bar 26 is made of nylon wherein a portion of end 28 is encapsulated.

A sleeve 32 also made fron nylon is forced fit about a top portion of lighter 10. More particularly, sleeve 32 has center portions 34*a*, 38*b* opposite each other that extend from a lower part of fire wall 18 to an upper part of tank 14. Additionally, center portion 34*a*, has a recess 36 (FIG. 3) of a shape generally complementary to end 28. Moreover, center portion 34*a* has a pin 38 retained therein that passes through hole 30. Accordingly, bar 26 is operable to pivot about pin 38.

Center portion 34*b* has a groove 40 at one end. The open end of groove 40 is narrower than the center thereof. The distal end 42 of bar 26 is of substantially complementary shape to groove 40. Since nylon is an elastic material, end 42 may be forced into groove 40. Because the open end of groove 40 is narrow, end 42 is locked within groove 40.

Sleeve 32 further includes a portion 44 that fits about tank 14 proximal to lever 12. When end 42 is locked within groove 40, bar 26 rests upon portion 44, whereby bar 26 is in its lock position. In the lock position, lever 12 is maintained against depression, thereby sealing tank 14. It should be understood that lever 12 can only be depressed when bar 26 is pivoted from portion 44.

In addition to portions 34*a*, 34*b*, 44, sleeve 32 has a portion 46 that fits about firewall 18. Portion 46 rests upon a lip 48 connected to firewall 18 and tank 14. Hence, lip 48 maintains sleeve 32 against translation along tank 14.

Although this embodiment includes components made from nylon, they may alternatively be made from polycarbonate, polyethelene, methyl methelmethacrylate, polypropolene, polystyrene or acrylonitrile butadiene styrene.

Although the subject matter of the invention is referred to herein as a cigar lighter, it should be understood that it may be used for lighting a cigarette or any other article or substance.

While the invention has been particularly shown and described with reference to a preferred embodiment it should be understood by those skilled in the art that changes in the form and detail may be made therein without departing from the spirit and the scope of the invention.

I claim:

1. A cigar lighter of the type that has a fuel tank with an orifice for passing fumes therethrough comprising:

a thumbwheel operable to cause a spark that ignites said fumes;

a spring loaded lever that seals said orifice, said orifice being unsealed in response to said lever being depressed; and means connected to said tank for selectively and repeatedly maintaining said lever against depression, said means being positioned directly below an exposed portion of said lever to prevent said depression and including a portion pivotally mounted into a position blocking depression of said lever or into a position wherein depression of said leaver is not blocked.

2. The cigar lighter of claim 1 wherein said means comprises:

a bar operably to lock in a position to maintain said lever against depression, said bar being in the general shape of a bellcrank and having a horizontally planar disposition, said plane of disposition being parallel to a horizontal plane within which a rotational axis of said thumbwheel is disposed.

3. The cigar lighter of claim 2 wherein said means comprises:

a sleeve that is forced fit about said lighter, said sleeve having a pin that passes through the proximal end of said bar to cause said bar to be pivotally connected to said sleeve.

4. The cigar lighter of claim 3 wherein the proximal end of said bar is made from metal and is partially encapsulated in a non-metallic portion of said bar, said non-metallic portion and said sleeve being made from plastic.

5. A cigar lighter of the type that has a fuel tank with an orifice for passing fumes therethrough comprising:

a thumbwheel operable to cause a spark that ignites said fumes;

a spring loaded lever that seals said orifice, said orifice being unsealed in response to said lever being depressed; and means connected to said tank for maintaining said lever against depression, said means comprising a bar, in the general shape of a bellcrank, operably to lock in a position to maintain said lever against depression and comprising a sleeve that is forced fit about said lighter, said sleeve having a pin that passes through the proximal end of said bar to cause said bar to be pivotally connected to said sleeve, said sleeve further having a groove narrower at its center than at its open end and the distal end of said bar is of a shape complementary to said groove, said bar being operable to have said distal end retained in said groove, whereby said bar is locked in said position.

6. The cigar lighter of claim 4 wherein said plastic is selected from a group consisting of nylon, polyetherlene, nethyl methylmethacrylate, polypropalene, polystyrene and acrylonitrile butadiene styrene.

* * * * *